US007568302B1

(12) United States Patent
Bubits

(10) Patent No.: US 7,568,302 B1
(45) Date of Patent: Aug. 4, 2009

(54) HANDGUN AND LOCKING MEANS FOR A HANDGUN

(75) Inventor: Wilhelm Bubits, Lutzmannsburg (AT)

(73) Assignee: Caracal International L.L.C., Abu Dhabi (AE)

( * ) Notice: Subject to any disclaimer, the term of this patent is extended or adjusted under 35 U.S.C. 154(b) by 0 days.

(21) Appl. No.: 12/062,965

(22) Filed: Apr. 4, 2008

(51) Int. Cl.
*F41A 17/00* (2006.01)

(52) U.S. Cl. ..... 42/70.02; 42/70.01; 42/70.11

(58) Field of Classification Search ..... None
See application file for complete search history.

(56) References Cited

U.S. PATENT DOCUMENTS

| | | | | | |
|---|---|---|---|---|---|
| 2,372,519 | A * | 3/1945 | Roper | 89/137 |
| 4,245,418 | A * | 1/1981 | Kennedy | 42/7 |
| 4,326,353 | A * | 4/1982 | Ludwig et al. | 42/7 |
| 4,532,729 | A * | 8/1985 | Von Muller | 42/70.11 |
| 5,231,236 | A * | 7/1993 | Del Real et al. | 42/70.11 |
| 5,467,550 | A * | 11/1995 | Mumbleau | 42/70.11 |
| 5,581,927 | A * | 12/1996 | Meller | 42/70.11 |
| 5,987,796 | A * | 11/1999 | Brooks | 42/70.11 |
| 6,052,934 | A * | 4/2000 | Carpenter | 42/70.11 |
| 6,412,207 | B1 * | 7/2002 | Crye et al. | 42/70.06 |
| 6,952,895 | B1 * | 10/2005 | Zonshine | 42/70.02 |
| 7,222,450 | B2 * | 5/2007 | Cuprin et al. | 42/70.11 |
| 7,240,449 | B2 * | 7/2007 | Clifton, Jr. | 42/70.11 |
| 2003/0136043 | A1 * | 7/2003 | Lauster et al. | 42/70.11 |
| 2006/0080881 | A1 * | 4/2006 | Cuprin et al. | 42/70.02 |

* cited by examiner

*Primary Examiner*—Michael Carone
*Assistant Examiner*—Samir Abdosh
(74) *Attorney, Agent, or Firm*—Greer, Burns & Crain, Ltd.

(57) ABSTRACT

A handgun and a locking device for a handgun are disclosed, which handgun includes a housing, a magazine-receiving space in the housing, a slide movable in the housing, and a trigger mechanism; the locking device includes a locking body to be inserted in the magazine-receiving space, the locking body at least partially being shaped like a magazine and including a releasable catch engaging in the magazine-receiving space when the locking body is in its inserted state, and cooperating with an eccentric provided in the locking body.

15 Claims, 3 Drawing Sheets

HANDGUN AND LOCKING MEANS FOR A HANDGUN

FIELD OF INVENTION

The invention generally relates to a locking means for a handgun, in particular a pistol, as well as to a handgun comprising such a locking means. The handgun may, e.g., be a fully automatic pistol (submachine gun) as well as a semi-automatic pistol of any construction desired, as long as it is designed with a receiving space for an insertable magazine. Accordingly, the magazine receiving means may be a short flange, or it may be the pistol stock of a self-loading pistol. In particular, the invention relates to locking or safety means, respectively, for such handguns or pistols, respectively, comprising magazine-receiving pistol stocks.

BACKGROUND OF THE INVENTION

Known safety means (cf. e.g. U.S. Pat. No. 4,658,529 A, DE 4 013 124 A and AT 411 934 B) either act on the firing mechanism (hammer or firing pin) or on the trigger mechanism or on the trigger of firearms. In the simplest case, the safety means consist of a block inserted in the trigger guard. These devices are effective in the most varying situations. Nevertheless, security flaws still exist which above all may become critical with privately owned pistols, e.g. if an ignorant or curious person, such as a child, seizes the pistol. Thus, these known safety means in most cases cannot prevent repeating of the pistol by retracting the slide. In doing so, either a round can be inserted into the cartridge chamber or a live round can be ejected if there is still a round in the weapon (which happens frequently), or if the user has forgotten to remove the magazine or, at least, to unload. However, live rounds are always a source of danger.

On the other hand, it has been suggested—cf. e.g. U.S. Pat. No. 4,224,753 A, to insert a dummy cartridge into the cartridge chamber and to connect it with a rod extending through the barrel, which rod may also be replaced by a cord, wherein the rod or cord, respectively, at the muzzle is connected to a lock which can only be removed by means of a special tool or key. This safety of pistols has been particularly proposed for sales outlets and is comparatively cumbersome to use.

A locking device for a pistol is further known from U.S. Pat. No. 6,052,934 A. In detail, this locking device comprises a plate-shaped, elongated locking body which, with the slide retracted, is pushed from the top side through the cartridge ejection port and furthermore, through the magazine well in the pistol stock, the end of the locking body projecting at the bottom from the pistol stock being secured by a padlock; at the upper end of the locking body, a transverse pin extends transversely to the ejection port, with the transverse pin resting on the slide with both of its ends such that with the padlock attached, the locking device can no longer be removed from the pistol. With this type of safety, it is i.a. disadvantageous that a certain movability of the locking body within the pistol is unavoidable, whereby possibly fine-mechanical components which are present in the slide, in the region of the trigger mechanism, of the ejector etc., may become damaged. Add to this that mounting as well as the removal of this locking device is comparatively cumbersome.

U.S. Pat. No. 4,532,729 A discloses a magazine-type locking body which, in its active locking position, blocks a trigger directly or indirectly; or blocks a bolt carrier with the aid of an advanced screw engaging into a locking hole of the bolt carrier; or blocks a breech face by means of a lug, thereby blocking introduction of ammunition into the firing chamber; or blocks the firing mechanism forward of a trigger by means of a blocking lug.

Moreover, WO 97/46847 A shows another type of safety device, including a securing part inserted into the barrel, however, with pivotable cams frictionally engaging the barrel interior wall. In WO 97/16693, a locking jaw with its fork end engages a housing surface. According to FR 2 846 737 A, a locking pin projects into a pocket of the housing of a firearm. Similarly, DE 40 09 372 A shows a locking bolt engaging the housing for blocking the metal locking body within the magazine receiver.

SUMMARY OF THE INVENTION

It is now an object of the invention to provide an improved safety, i.e. a locking means, for a handgun, and a handgun equipped with such a locking means, wherein a high amount of safety, also with a view to the release of live rounds, is achieved, on the one hand, and detrimental effects on components of the weapon, particularly also on other safety provisions, are avoided, on the other hand. The safety of the weapon will be at an optimum when there is no round in the weapon, and when no magazine is attached. Any possible damage of elements of the weapon is prevented if the locking body is immovably fixed in its inserted state within the weapon.

This object is achieved according to the invention by a locking means and by a handgun comprising such locking means, where said handgun includes a housing, a magazine-receiving space provided in said housing, a slide movable along a path in said housing, and a trigger mechanism. The locking means comprise a locking body configured to be inserted in said magazine-receiving space, said locking body at least partially being shaped like a magazine and including an interior, a forward front face, viewed in the firing direction of said handgun, a part contoured like a round and protruding into the path of the slide when said locking body is inserted in said magazine-receiving space, and a releasable catch engaging in said magazine-receiving space when said locking body is in its inserted state, said catch being designed as a latch arranged in said forward front face of said locking body and having an upper end, a lower end and a heel, said upper end of said latch being pivotable about an axis, said lower end of said latch forming an end face downwardly supported in said housing when said locking body is inserted in said magazine-receiving space, and said heel projecting into said locking body interior and having a heel face facing said axis, said heel face cooperating with an eccentric provided in said locking body.

Thus, a tightly fitting locking body is introduced into the magazine-receiving space, said locking body having a part which protrudes into the path of the slide and which substantially has the contour of a round. The locking body further contains a catch which can be released by authorized persons and which engages in the housing, in particular in the magazine-receiving space. With this catch, the slide, or breech, respectively, is locked in both directions: it cannot be moved forwards since the locking body protrudes into its path, and it cannot move backwards, either, since the locking body upper part, which has the contour of a round, does not yield like a round and, therefore, the breech block nose of the slide, or breech, respectively, gets caught thereon. Moreover, the locking body can be mounted easily, and its mounting necessitates the removal of any possibly present magazine from said magazine-receiving space.

Even if—after removal of the magazine—a round still remains in the weapon, the safety thereof is not negatively affected because the slide will be blocked. From the tactical standpoint, this even has the advantage that in case of an unexpectedly starting gunfight, a shot can be fired immediately upon removal of the locking body from the magazine-receiving space, while a magazine filled with rounds can be taken with the other hand and introduced into the magazine-receiving space.

In case of a self-loading pistol having a pistol stock which forms the magazine-receiving space, an advantageous embodiment consists in that the locking body has the entire spatial outer contour of an associated magazine and the catch projects outwards from said outer contour and is actuatable from the bottom of the locking body by means of a lock. Here, the locking body can be inserted into the magazine-receiving space in the pistol stock just like a magazine.

By "lock", any blocking means is to be understood, e.g. also a device for setting a code number. In particular, however, a common cylinder lock is envisaged. With such a lock, the catch can be pushed forwards of backwards. In a particularly practical design, the catch is actuated outwards by a spring, and retractable against the force of said spring by means of said lock. Thus, the locking body may simply be inserted instead of a magazine until the catch snaps in in the pistol stock.

The locking body may also supplement other safety means by having an abutment face in its upper region which lockingly cooperates with a member of the trigger mechanism (the trigger itself or with any other member of the kinematic chain between trigger and firing pin) or with any other part which is pertinent to the functioning of the gun. Preferably, the abutment surface is located transversely to the firing direction, and the member of the trigger mechanism which cooperates with the abutment surface is the trigger bar which has a locking nose for this purpose that is arranged in front of said abutment surface with regard to the triggering movement.

The catch, or latch, respectively, may be an approximately horizontally displaceable part; and the counter-surface of the housing supporting the end face may be worked into the housing, or into the pistol stock, respectively, as a slight threshold; often, however, a suitable surface already exists. The level of the latch, which latch may be mounted at any level desired, then needs to be adapted to this surface.

Suitably, the locking means according to the invention can be mounted on the firearm without any changes. Therefore, the invention also relates to a locking means as such, having the features described above.

Further advantageous details of the construction of the locking body are an approximately horizontal recess, the bottom area of which forming an abutment for the latch that is provided as said catch; and a hairpin spring arranged above said latch.

According to the invention, a minimum of parts which, moreover, are simple to produce will suffice.

BRIEF DESCRIPTION OF THE DRAWINGS

The invention will now be explained in more detail by way of particularly preferred exemplary embodiments illustrated in the drawings without, however, being restricted thereto. Therein, FIG. 1 schematically shows a pistol with a locking or safety means in a longitudinal section.

DETAILED DESCRIPTION OF THE PREFERRED EMBODIMENT

Figure 1:
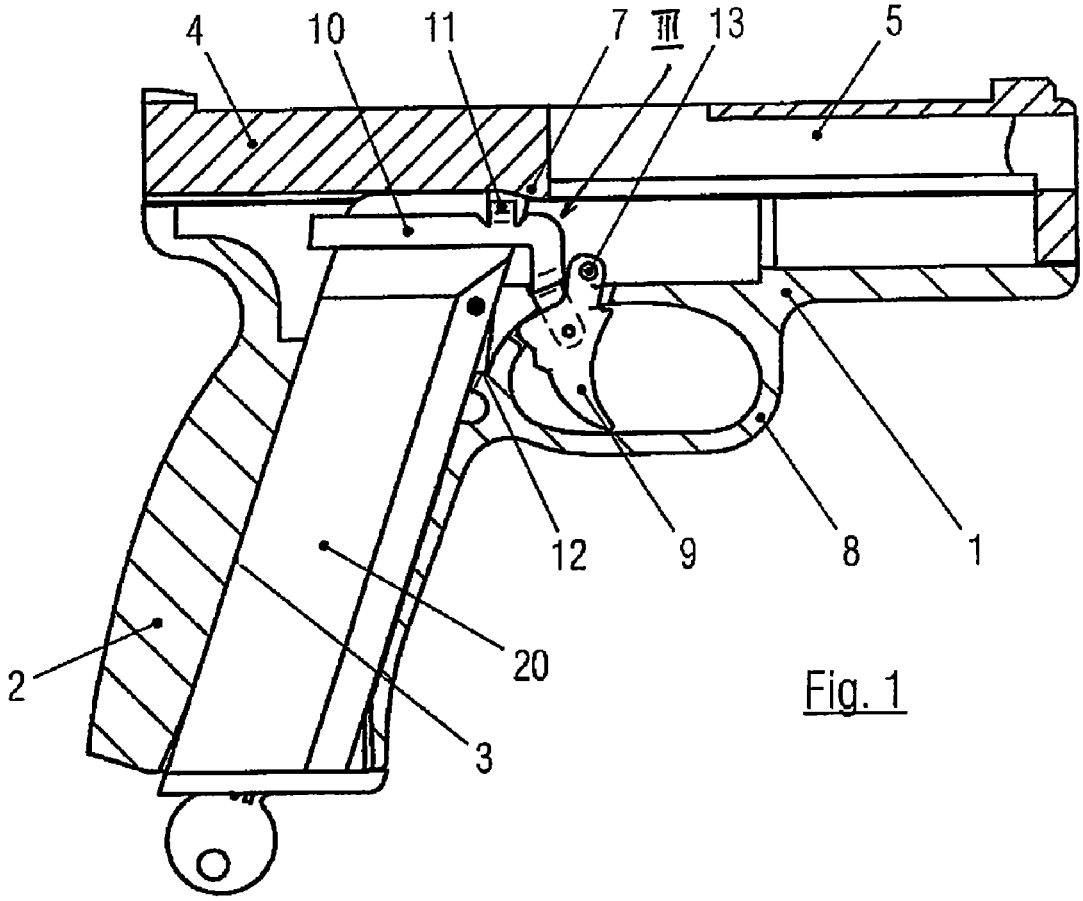

In FIG. 1, a pistol having a housing 1 is shown. In the exemplary embodiment illustrated, this is a self-loading pistol of conventional construction having a pistol stock 2 forming a receiving space 3 for a magazine of rounds, and which further includes a slide 4 with a breech (shown only schematically), firing means (not shown) and a barrel 5. However, the invention is suitable for all kinds of pistols, i.e. also for automatic pistols and other firearms, as long as they are provided for an insertable or exchangeable magazine, i.e. include a magazine-receiving space as well as, preferably, a breech block nose 7 for conveying rounds or cartridges, respectively, from the magazine into a cartridge chamber.

Furthermore, in FIG. 1, a trigger 9 surrounded by a trigger guard 8 and movable about an axle 13 is shown; the trigger 9 acts via a trigger bar 10 and further members of a kinematic chain on a firing device known per se and not further illustrated. The trigger bar 10 has a locking nose 11 for cooperation with a locking body 20 of a locking mechanism. In the interior of the housing 1, a narrow, upwardly directed counter-surface 12, a type of threshold, is also formed or present.

Figure 2:
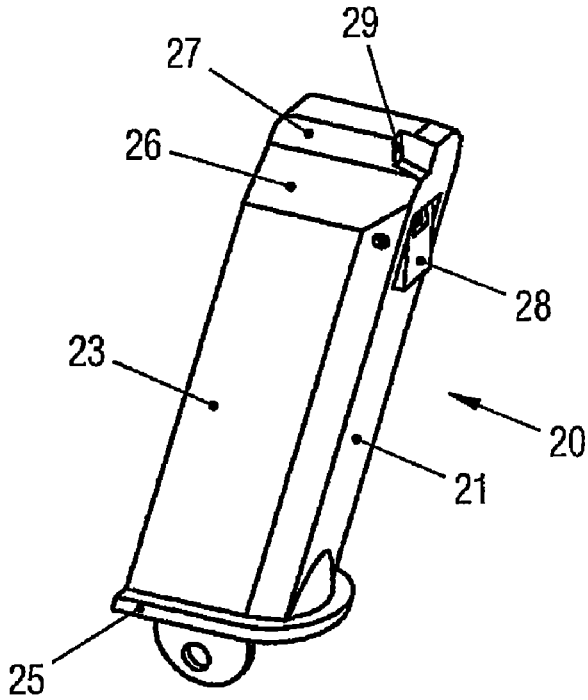
FIG. 2 shows a locking means alone, in an axonometric view.

FIG. 2 shows the locking body 20 which is introduced into the magazine-receiving space 3 instead of a magazine, as a supplement to known safety means, so as to even better protect the weapon against unauthorized actuations. Therefore, the locking body 20 has parts identical to those of a magazine, which fit into the magazine-receiving space 3. In the case of the pistol described here, the locking body 20 entirely has the contour of a magazine. This contour (cf. also FIGS. 2, 5 and 6) is formed by a front wall 21, a rear wall 22, side walls 23, 24, a bottom 25 and a constriction 26 of the locking body 20. The constriction 26 corresponds to the upper rim zone of a magazine in which the uppermost round or cartridge is held such that it may be pushed by the breech block nose 7 into the cartridge chamber of the barrel 5. The locking body 20 has an upper part, called head 27 in short hereinafter, which approximately corresponds to the contour of a thus-held round, yet which is an integral part of the locking body 20. So to speak, the head 27 is a "round which cannot be pushed out of the magazine".

Furthermore, a catch having the form of a latch 28 protrudes from the front face 21 of the locking body 20, said latch 28 locking the inserted locking body 20 in the housing 1 by resting against the counter-face 12.

The head 27 is responsible for the locking effect of the locking body 20. When the slide 4 is in its normal front position, the head 27 prevents working of the slide of the pistol by retracting the slide and, in the opened rear position of the slide 4, prevents its forward movement (i.e. in firing direction). Thus, it is not possible to convey a round, or cartridge, respectively, from the magazine into the cartridge chamber. If one attempts to manually insert a round into the loading space, the round cannot be loaded. Thus, a security deficiency is removed.

Figure 3:
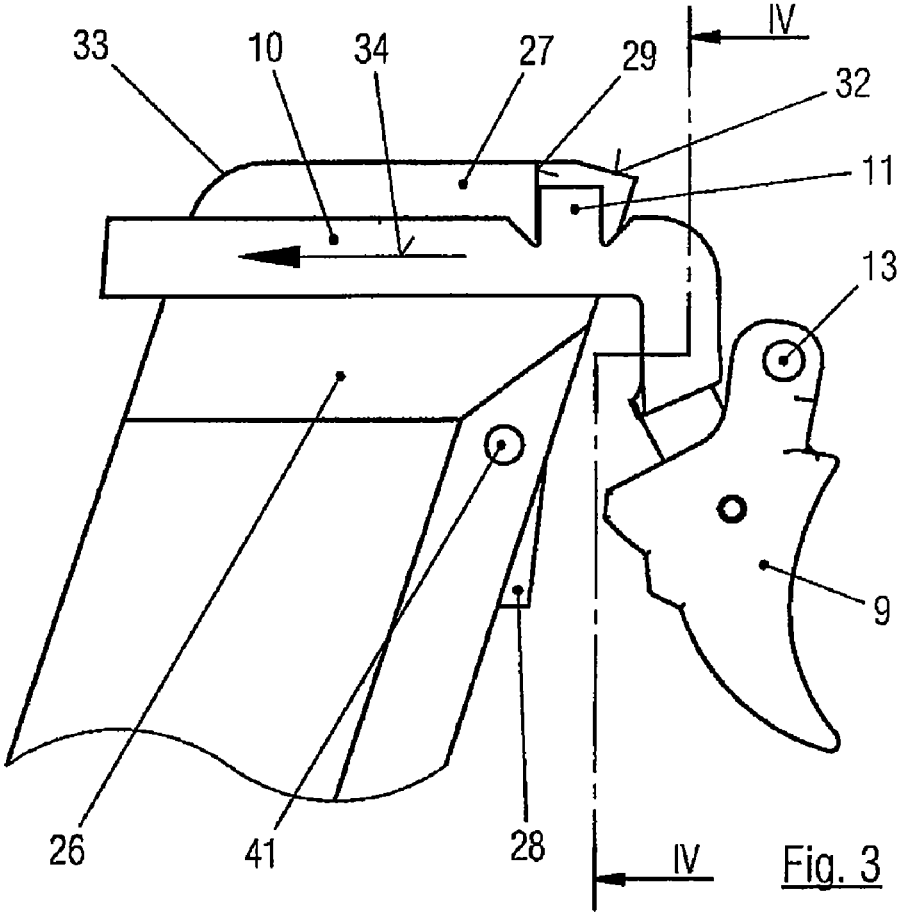
FIG. 3 shows the detail III of FIG. 1, on an enlarged scale.
Figure 4:
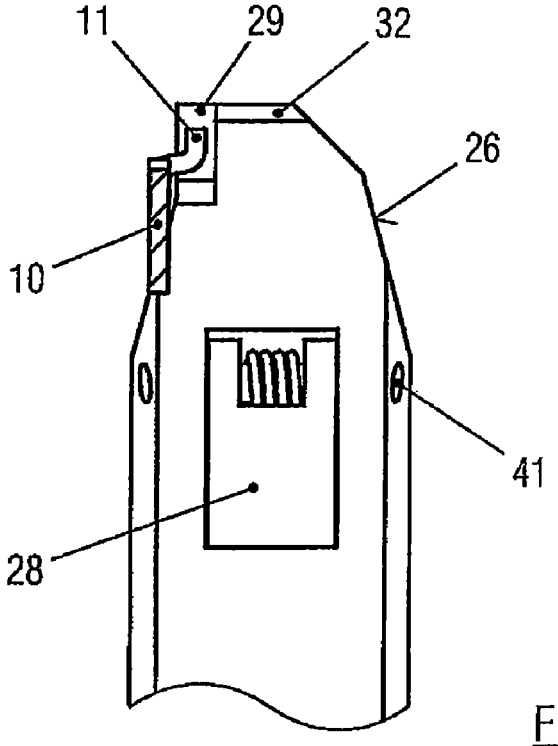
FIG. 4 shows a cross-section according to line IV-IV of FIG. 3.

FIGS. 3 and 4 show the details intended for this effect and further effects on an enlarged scale. The head 27 of the locking body 20 forms a first thrust surface 32 on its front side and a second thrust surface 33 at its rear side. The first thrust surface 32 prevents the slide 4 from moving backwards, and the second thrust surface 33 prevents the slide from moving forwards from the retracted position. The locking nose 11 of the trigger bar 10 arranged laterally of the locking body 20, or of the magazine, respectively, is cranked inwards so that it will be pre-vented from moving in the triggering direction 34 by a stop face 29 of the locking body 20.

Figure 5:
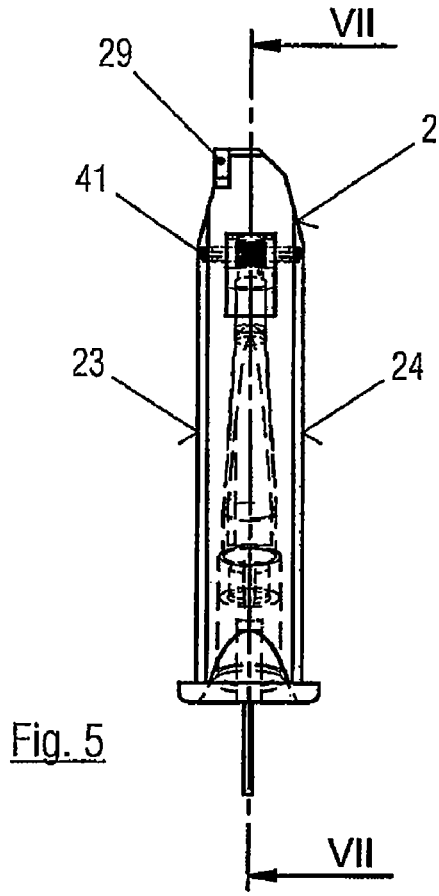
FIG. 5 shows an end view of a locking means, seen from the front.
Figure 6:
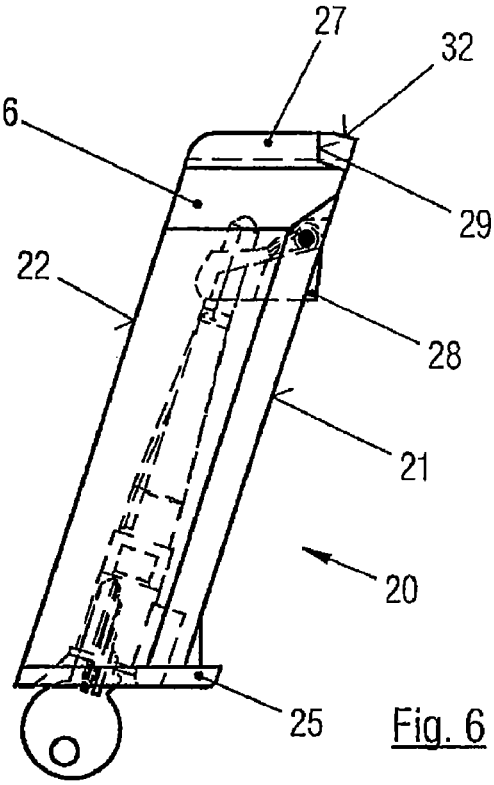
FIG. 6 shows a side view of this locking means.
Figure 7:
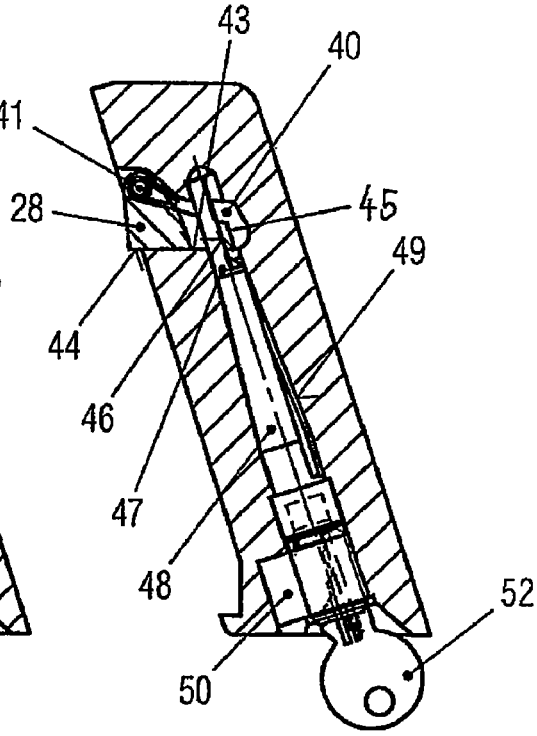
FIG. 7 shows a section according to line VII-VII of FIG. 5, with the catch in the locking position.

In FIGS. 5 and 6, the locking body 20 which has already been described in FIG. 2 is shown in more detail, wherein also the arrangement of the latch 28 and of the associated elements is schematically illustrated. FIG. 7 shows a section of the locking body 20 in its locking position. It may be seen that the latch 28 is received in an approximately horizontal recess 40. The latch 28 is pivotable about an axis 41 formed by a pin that is pushed transversely through the locking body 20 and the upper end of the latch 28, said latch 28 being pressed outwards by a hairpin spring 42. When inserting the locking body 20 into the magazine-receiving space 3, the latch 28 is pressed inwards, then, after having reached the locking position, the latch 28 snaps in with its end face 44 over the counter-surface 12 (cf. FIG. 1) on account of the force of the hairpin spring 42, thus locking the locking body 20 in the housing 1. In the position shown in FIG. 7, the bottom face 43 of the recess 40 serves as abutment. The latch 28 has a heel 45 extending into the interior of the recess 40, with a surface 46 facing the axis 41, said surface 46 cooperating with an eccentric 47 (that has a cross-section which here is a segment of a circle, e.g.).

The eccentric 47 is the uppermost part of an eccentric shaft 48 which is accommodated here by a partially conical longitudinal bore 49 in the locking body 20. On the lower end of the eccentric shaft 48, a cylinder lock 51 is mounted. In order to receive the cylinder lock 51, the longitudinal bore 49 is enlarged, said enlargement being shown in FIGS. 7 and 8 at 50. In this manner, the cylinder lock 51 is accessible for a key 52 from the bottom 25 of the locking body 20.

Figure 8:
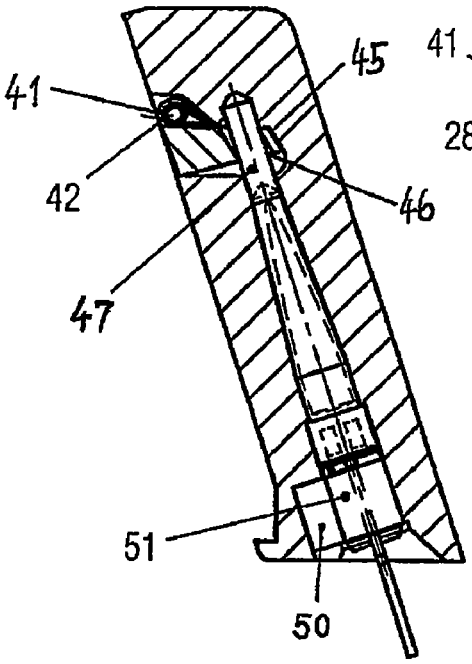
FIG. 8 shows the unlocked position in a similar section.

FIG. 8 shows the unlocked position of the locking body 20, in which the latter can be pulled out of the pistol. Here, this position is obtained by rotating the key 52 about a quarter circle. In doing so, the eccentric 47 rotates, pressing against the surface 46 on the heel 45 of the latch 28. In this manner, the latch 28 is retracted.

Within the scope of the invention, the shape of the locking body 20 may, of course, be adapted to the type of the respective weapon. The catch 28 and the mechanism actuating it as well as the lock device 51 also can be varied within a wide range. Likewise, the locking elements 32, 33, 29 on the head 27 of the locking body 20 may be arranged and designed in accordance with the associated weapons.

What is claimed is:

1. A locking means for a handgun which includes a housing, a magazine-receiving space provided in said housing, a slide movable along a path in said housing, and a trigger mechanism, said locking means comprising:

a locking body configured to be inserted in said magazine-receiving space, said locking body at least partially being shaped like a magazine and including an interior, a forward front face, viewed in the firing direction of said handgun, a part protruding into said path of said slide when said locking body is inserted in said magazine-receiving space, and a releasable catch engaging in said magazine-receiving space when said locking body is in its inserted state, said catch being designed as a latch arranged in said forward front face of said locking body and having an upper end, a lower end and a heel, said upper end of said latch being pivotable about an axis, said lower end of said latch forming an end face downwardly supported in said housing when said locking body is inserted in said magazine-receiving space, and said heel projecting into said locking body interior and having a heel face facing said axis, said heel face cooperating with an eccentric provided in said locking body.

2. The locking means set forth in claim 1, wherein said locking body has an outer contour like a magazine and a bottom and is arranged to be inserted instead of a magazine in a grip of said handgun, said locking body further containing a lock, said catch of said locking body projecting outwards and being actuatable from said bottom of said locking body by means of said lock.

3. The locking means set forth in claim 1, wherein said eccentric is rotatable, said locking means further comprising a spring, said catch projecting from a peripheral face of said locking body and being actuated outwards by said spring and retractable against the force of said spring by means of said rotatable eccentric.

4. The locking means set forth in claim 2, wherein said eccentric is rotatable, said locking means further comprising a spring, said catch projecting from a peripheral face of said locking body and being actuated outwards by said spring and retractable against the force of said spring by means of said rotatable eccentric.

5. The locking means set forth in claim 3, wherein said locking body has a longitudinally extending bore in its interior, said eccentric being rotatably arranged in said longitudinal bore.

6. The locking means set forth in claim 4, wherein said locking body has a longitudinally extending bore in its interior, said eccentric being rotatably arranged in said longitudinal bore.

7. The locking means set forth in claim 5, wherein said eccentric has a lower end, said lock being received at said lower end of said eccentric.

8. The locking means set forth in claim 7, wherein said lock is a cylinder lock.

9. The locking means set forth in claim 1, wherein said locking body has an approximately horizontal recess with a bottom face for receiving said latch, and further comprises a hairpin spring arranged above said latch for urging said latch outwards, said bottom face of said approximately horizontal recess forming an abutment for said latch.

10. The locking means set forth in claim 1, wherein said locking body includes an abutment face in its upper region for said trigger mechanism of said handgun.

11. A handgun comprising:

a housing containing a trigger mechanism and a magazine-receiving space, a slide containing a breech, a barrel, and locking means including a locking body, said locking body being designed so as to be inserted in said magazine-receiving space of said handgun, said locking body at least partially being shaped like a magazine and including an interior, a forward front face, viewed in the firing direction of said handgun, a part protruding into said path of said slide when said locking body is inserted in said magazine-receiving space, and a releasable catch engaging in said magazine-receiving space when said locking body is in its inserted state, said catch being designed as a latch arranged in said forward front face of said locking body and having an upper end, a lower end and a heel, said upper end of said latch being pivotable about an axis, said lower end of said latch forming an end face downwardly supported in said housing when said locking body is inserted in said magazine-receiving space, and said heel projecting into said locking body interior and having a heel face facing said axis, said heel face cooperating with an eccentric provided in said locking body.

12. The handgun set forth in claim 11, wherein said housing has a grip configured as a magazine-receiving space and said locking body has an outer contour like a magazine and is inserted in said magazine-receiving space.

13. The handgun set forth in claim 11, wherein said locking body has an abutment surface in its upper region provided for said trigger mechanism of said handgun, said trigger mechanism including an element cooperating with said abutment surface so as to arrest said trigger mechanism.

14. The handgun set forth in claim 13, wherein said abutment surface is disposed transversely to the firing direction and said trigger mechanism element cooperating therewith is a trigger bar having a locking nose arranged in front of said abutment surface with regard to the triggering movement.

15. The handgun set forth in claim 11, wherein said end face formed by said lower end of said latch is downwardly supported on a counter-face of said housing of said handgun.

* * * * *